United States Patent [19]

Johnson

[11] 4,232,590

[45] Nov. 11, 1980

[54] CUP MAKING MACHINE HAVING APPLICATOR MECHANISM

[75] Inventor: Warren E. Johnson, Bristol, Conn.

[73] Assignee: Sherwood Tool, Incorporated, Kensington, Conn.

[21] Appl. No.: 968,986

[22] Filed: Dec. 13, 1978

[51] Int. Cl.[3] ..... B31B 1/62

[52] U.S. Cl. ..... 493/10; 493/105

[58] Field of Search ..... 93/36 MM, 44.1 R, 44.1 GT, 93/39.2, 39.3, 56 PD; 53/383, 563

[56] References Cited

U.S. PATENT DOCUMENTS

| | | | |
|---|---|---|---|
| 732,225 | 6/1903 | Scales | 93/44.1 R |
| 3,202,065 | 8/1965 | Bolcato | 93/36 MM |
| 3,408,906 | 11/1968 | Heffelfinger et al. | 93/36 MM |
| 3,476,022 | 11/1969 | Scully | 93/36 MM X |
| 3,937,131 | 2/1976 | Kellogg | 93/53 R X |

*Primary Examiner*—James F. Coan

*Attorney, Agent, or Firm*—McCormick, Paulding & Huber

[57] ABSTRACT

A cup making machine having a turret for indexing a cup forming mandrel to successive forming stations and a hot melt applicator mechanism including a nozzle for applying a bead of hot melt material to a partially formed cup blank carried by the mandrel as it is indexed into position at one forming station. The nozzle is supported for compound movement relative to the mandrel in response to indexing movement of the turret so that a relatively straight bead of hot melt material is applied to a portion of the cup blank which travels in an arcuate indexing path.

10 Claims, 7 Drawing Figures

CUP MAKING MACHINE HAVING APPLICATOR MECHANISM

BACKGROUND OF THE INVENTION

This invention relates in general to machines for forming disposable paper containers and deals more particularly with a machine for making a disposable cup of a reclosable type which has an integral foldable closure retained in closed position by a resilient plastic clip. In making a cup of the aforedescribed general type, a relatively straight bead of hot melt material must be applied near a marginal edge of the closure to aid in retaining the clip which, in turn, retains the container in closed position. When a cup such as aforedescribed is made on a machine of the type which has a rotary indexible turret and cup forming mandrels which extend radially outwardly from the turret, a problem is encountered in forming the desired straight bead of hot melt material. The problem occurs because the portion of the partially formed cup blank to which hot melt material is applied at all times travels in an arcuate path as the mandrel which carries the blank is indexed to various forming stations. The present invention is concerned with this problem. More specifically, it is the general aim of the present invention to provide an applicator mechanism for a machine of the afore-described type and which applies a relatively straight bead of material to an associated portion of a cup blank while said associated portion is conveyed along an arcuate path.

SUMMARY OF THE INVENTION

In accordance with the present invention, a container making machine is provided which has a frame, a rotary turret supported on the frame for indexing movement about an axis to a plurality of successive container forming stations, a container forming mandrel mounted on the turret and extending radially outwardly therefrom, and an applicator mechanism. The applicator mechanism includes an applicator for applying material to a container blank carried by the mandrel, means supporting the applicator for movement relative to the frame and the mandrel, and means for moving the applicator relative to both the machine frame and the mandrel in response to indexing movement of the turret relative to the machine frame. CL BRIEF DESCRIPTION OF THE DRAWING FIG. 1 is a perspective view of a container made on a machine embodying the present invention.

DETAILED DESCRIPTION OF PREFERRED EMBODIMENT

Figure 1:
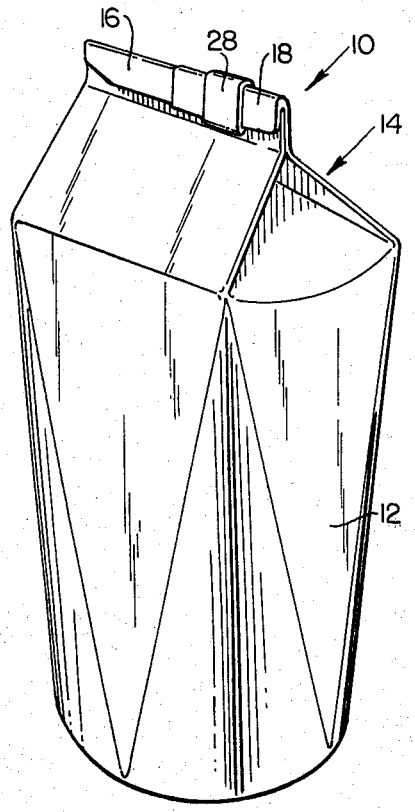
Figure 2:
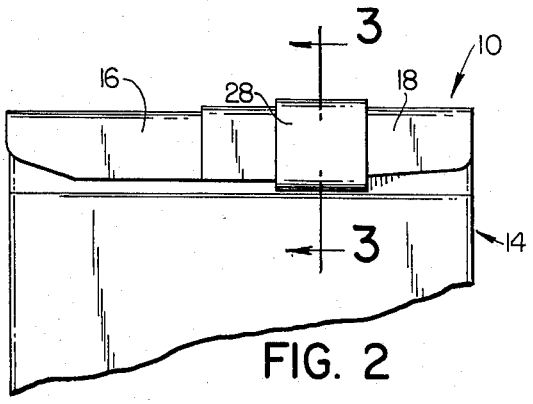
FIG. 2 is a somewhat enlarged fragmentary side elevational view of the container of FIG. 1.
Figure 4:
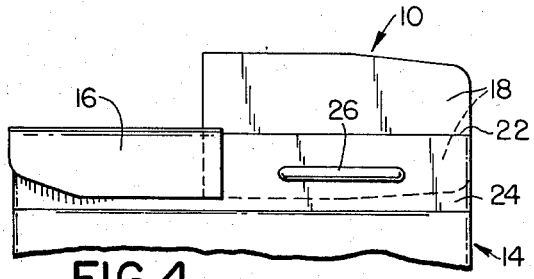
FIG. 4 is similar to FIG. 2 but shows the container with the clip removed and one of the closure flaps in an open condition
Figure 3:
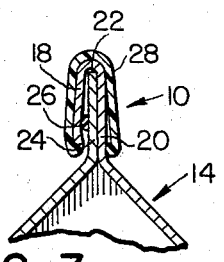
FIG. 3 is a fragmentary sectional view taken along the lines 3—3 of FIG. 2.

The present invention is concerned with a machine for making a disposable paper receptacle of the type used to package beverages and the like which has an integral closure retained in closed position by a resilient clip. A typical container of the aforedescribed type, shown in FIGS. 1–4 and indicated generally by the reference numeral 10, is formed from treated paper and has a generally frustro-conical body portion 12 and an integral closure, designated generally by the numeral 14, connected to the upper end of the body portion 12. The closure 14 includes a plurality of closure panels, connected together along fold lines and inwardly foldable to closed position, and a pair of overlapping closure flaps 16 and 18, respectively, connected to one of the closure panels, indicated at 20, along a fold line 22. The overlapping portion of the flaps 16 and 18 is defined by a continuation of an overlapped seam which extends longitudinally of the body and closure portions of the container 10. In closed position, shown in FIG. 2, the closure flaps 16 and 18 overlie associated portions of another closure panel 24. A relatively straight bead of the hot melt material 26 is adhered to the panel 24 and extends for some distance therealong in generally parallel relation to the upper marginal edge of the panel 26, as best shown in FIG. 4. A generally U-shaped resilient plastic clip 28, which has hook shaped free ends, as best shown in FIG. 3, retains the closure 14 in closed position. The clip 28 is removed by sliding it off the container in a lateral direction as indicated by the directional arrow 30 in FIG. 2. After the clip 28 has been removed and the closure 14 is opened the inwardly folded closure panels at the left side of the container, as it appears in FIGS. 2 and 4, may be folded outwardly to form a pouring spout.

To close the container 10 the various closure panels are folded inwardly to bring together the panels 20 and 24 at the upper end of the container, as shown in FIG. 3. The closure flap 16 is then folded into overlying relation with the panel 24. Thereafter, the closure flap 18 is folded from its open or full line position to its closed or broken line position of FIG. 4. The clip 28 is then slipped downwardly over the fold line 22 and is snapped into position on the closure flap 18 to straddle the fold line 22, as shown in FIG. 3. The bead 26 maintains the closing flap 18 in spaced relation to the panel 24 so that a hook on an associated leg of the resilient clip 28 positively engages the lower edge of the closing flap 18 whereby the clip is positively retained on the closing flap which, in turn, maintains the closure 14 in its closed position. Thus, the bead 26 provides for positive snap-on engagement of the clip with the container.

Figure 5:
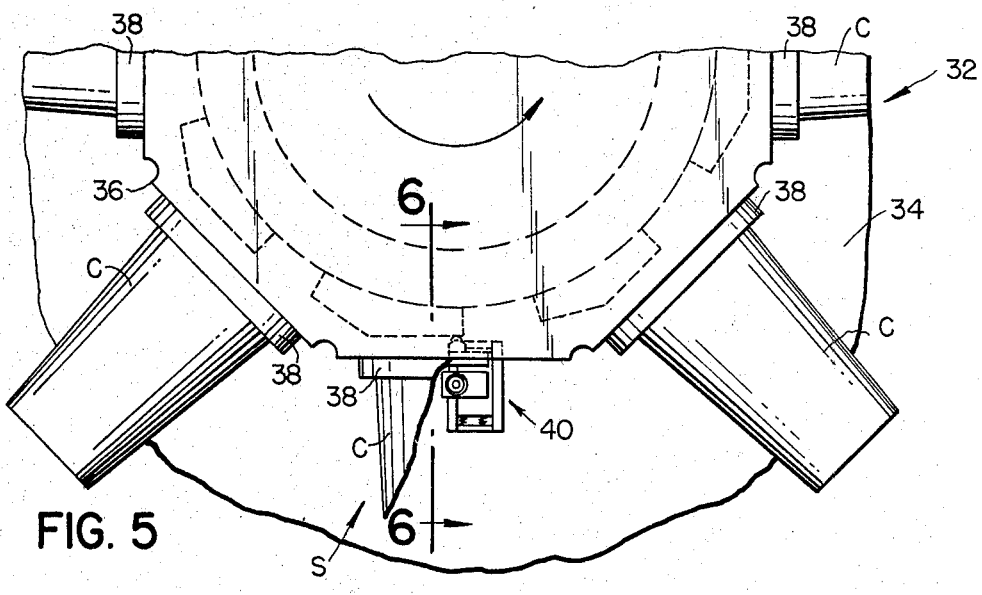
FIG. 5 is a somewhat schematic fragmentary plan view of a machine embodying the present invention.
Figure 6:
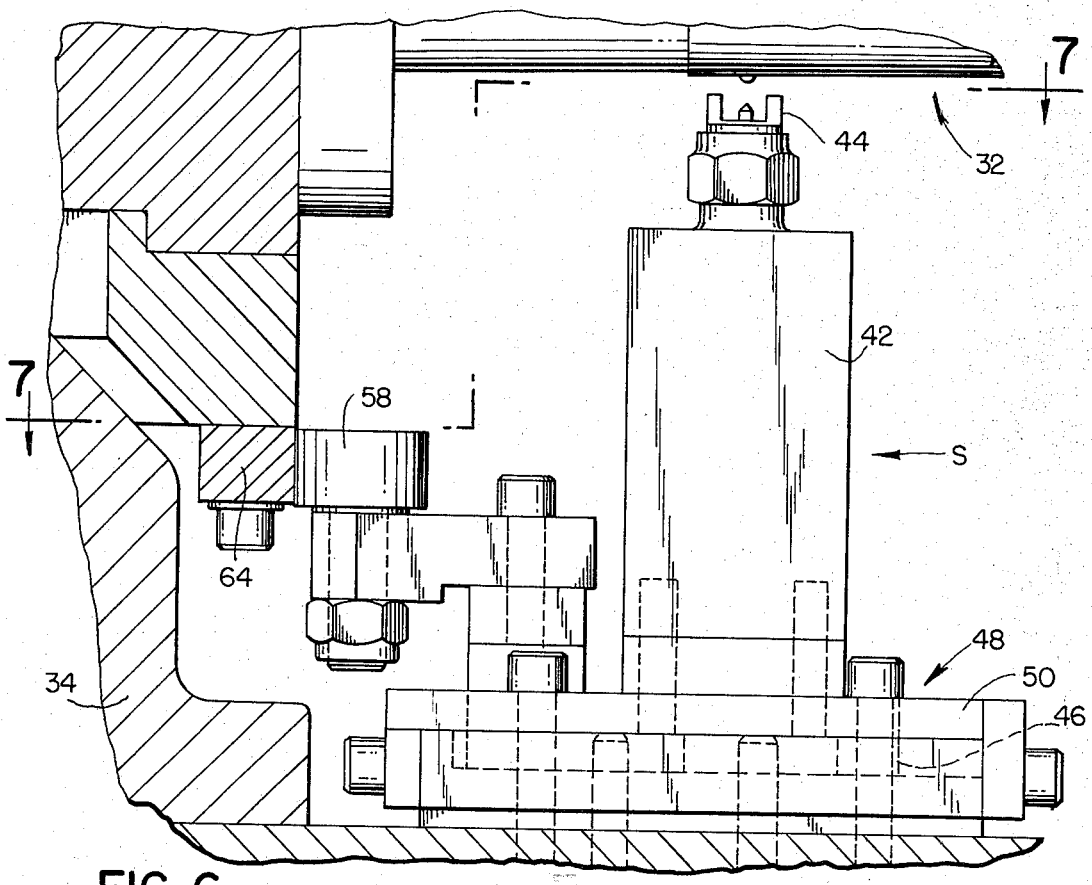
FIG. 6 is a somewhat enlarged sectional view taken generally along the line 6—6 of FIG. 5.
Figure 7:
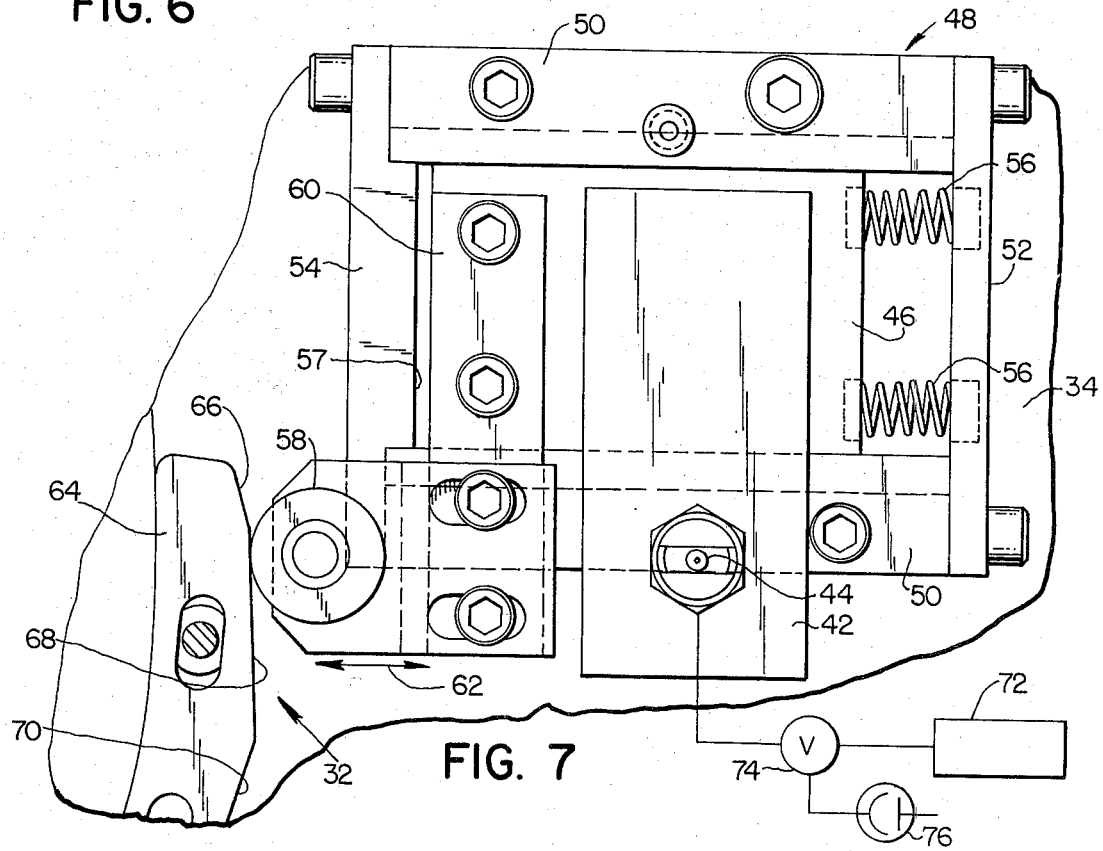
FIG. 7 is a fragmentary sectional view taken generally along the line 7—7 of FIG. 6.

A machine embodying the present invention and particularly adapted to make the container 10 is shown in FIGS. 5–7 and indicated generally by the reference numeral 32. The machine 32 may be generally characterized as a rotary turret cup making machine and has a frame 34 which supports a turret for rotation about a vertical axis and in a counterclockwise direction, as viewed from above, and as indicated by the directional arrow in FIG. 5. A plurality of cup forming mandrels 38, 38 are mounted on the turret 36 and extend radially outwardly therefrom, as best shown in FIG. 5. Each mandrel 38 has a generally frustoconical outer end portion for forming the body portion of the container 10 and an inner end portion which has a generally square cross section and upon which the closure portion 14 is formed. The turret 36 is supported for indexing movement relative to the machine frame 34 and to a plurality of successive container forming stations. At one of the stations each mandrel 38 receives a container blank C from an associated blank feeding mechanism (not shown). Each container blank C is secured to an associated mandrel by a clamping device, however, for clarity of illustration the clamping devices are not shown.

An applicator mechanism indicated generally at 40 and located at one container forming station, indicated generally by the letter S, applies material to the closure portion 14 of a container blank C to form a bead 26 thereon. At this point it should be noted that the portion of the container blank C to which the bead forming material is applied at all times moves in an arcuate direction as the container blank C is conveyed through the machine on an associated mandrel 38. However, the applicator mechanism 40 applies a relatively straight bead 26 to the arcuately traveling portion of a container blank C, as will be hereinafter further described.

Considering now the applicator mechanism 40 in further detail and referring more particularly to FIGS. 6 and 7, the applicator mechanism is particularly adapted to apply a bead of hot melt material to the container blank and includes an applicator indicated at 42 which has a nozzle 44. The illustrated applicator 42 is an Automatic Hot Melt Gun, Model H-20A, by Nordson Corporation, Amherst, Ohio, and is supported for controlled compound movement relative to each cup forming mandrel 38 as it moves into position at station S. More specifically, the applicator 42 is supported on the frame 34 for movement relative to both the frame and an associated cup forming mandrel 38 at station S in response to the indexing movement of the turret.

The applicator 42 is mounted in fixed position on a slide plate 46 supported for movement generally toward and away from the turret 34 by a rectangular guide assembly indicated generally at 48 and mounted in fixed position on the machine frame 34. The guide assembly 48 includes a pair of guide ways 50, 50 connected together at opposite ends by cross members 52 and 54. Springs 56, 56 act between the cross member 52 and the slide plate 46 to bias the slide plate in the direction of the turret 36. The cross member 54 has an abutment surface 57 for limiting the travel of the slide plate in the direction of the turret 36. The applicator 42 is mounted on the slide plate 46 so that the nozzle 44 is positioned to eject material in an upward direction and toward the lower surface of each container blank C as the mandrel 38 which carries it passes in close proximity to the nozzle.

The applicator mechanism 40 further includes a roller follower 58 carried by a bracket 60 secured in fixed position to the slide plate 46. The roller follower 58 is mounted on the bracket 60 for adjustment generally toward and away from the turret in the direction of the arrow 62, as best shown in FIG. 7.

The plurality of cams 64, 64 equal in number to the container forming mandrels 38 are secured to the turret, each cam 64 being mounted on the turret near an associated mandrel 38, as best shown in FIG. 5. Each cam 64 is slotted to receive mounting fasteners whereby it is secured for adjustable positioning in one or an opposite circumferential direction relative to the turret 36, as best shown in FIG. 7. Each cam 64 has three relatively straight generally radially outwardly facing cam surfaces designated by the numerals 66, 68, and 70 for engagement by the roller follower 58.

Hot melt material is pumped from a heat reservoir 72 to the nozzle 44. A suitable control mechanism, which may, for example, comprise a timer controlled solenoid valve 74 and a sensing device 76, operates the applicator 42 in timed relation to movement of the turret 36. The sensing device 76 may, for example, comprise a photoelectric cell, shown schematically in FIG. 7, and located as station S, which detects the presence of a cup blank on a mandrel at station S when the cup blank is in position to receive a bead of hot melt material from the nozzle 44 and operates the applicator mechanism 40.

Considering now the operation of the machine 32, when a mandrel 38 which carries a partially formed container blank is indexed toward the forming station S, the cam surface 66 engages the roller follower 58 to move the applicator nozzle 44 radially outwardly or away from the turret 36. The cam surface 68 engages the follower 58 as the bead receiving portion of the container moves into position over the nozzle 44. The sensing mechanism 76, which is responsive to the movement of the turret senses the presence of a container blank of the mandrel when it is properly positioned to receive a bead 26. The sensing device actuates the applicator 40 to eject a bead of hot melt material onto the portion of the container blank which defines the closure panel 24. As the turret travels along its arcuate path, the roller follower 58 travels along a substantially straight line path defined by the cam surface 68 causing slight radially outwardly movement of the nozzle away from the turret. Thus, the nozzle moves relative to both the frame 34 and an associated container forming mandrel 38. The resulting compound movement of the nozzle 44 relative to the container blank carried by the mandrel causes a relatively straight bead of hot melt material to be deposited on the container blank and in the position indicated by the numeral 26 in FIG. 5. When a bead of desired length has been applied to the container blank the timer associated with the sensing mechanism, which may be adjusted to determine the length of the bead, operates the valve 74 to cutoff the nozzle 44. The follower 58 then travels along the remainder of the cam surface 70 to return the nozzle 44 to its at rest position where it remains until the next container forming mandrel 38 is indexed into position at the forming station S.

I claim:

1. An applicator mechanism for a container making machine having a frame, a rotary turret supported on said frame for indexing movement about an axis to a plurality of successive container forming stations, and a container forming mandrel mounted in cantilever position on said turret with the axis of said mandrel extending radially outwardly from said turret, said applicator mechanism comprising applicator means for applying fluent material to an associated surface of a container blank carried by the moving mandrel as said mandrel indexes from one to another of said forming stations, said associated surface being disposed generally within a radial plane relative to the axis of said turret, means supporting said applicator means for movement relative to said turret, and means for moving said applicator means in material applying relation to a moving container blank carried by said moving mandrel in response to the indexing movement of said turret relative to said frame to apply a rectilinear strip of the fluent material to said associated surface of said moving container blank.

2. An applicator mechanism for a container making machine as set forth in claim 1 wherein said means for moving said applicator means is further characterized as means for moving said applicator means in a direction tangent to an arcuate path of said mandrel.

3. An applicator mechanism for a container making machine as set forth in claim 2 wherein said means for moving said applicator means comprises a cam.

4. An applicator mechanism for a container making machine as set forth in claim 3 wherein said applicator means is supported on said frame and said cam is mounted on said turret.

5. An applicator mechanism for a container making machine as set forth in claim 4 wherein said means for moving said applicator means includes biasing means for urging said applicator means generally toward said turret and a cam follower for engaging said cam.

6. An applicator mechanism for a container making machine as set forth in any one of claims 1–5 wherein said applicator means includes a nozzle for ejecting fluent material toward said mandrel and in a generally transverse direction relative to the axis of said mandrel.

7. An applicator mechanism for a container making machine as set forth in claim 1 wherein said applicator means is supported for movement in a generally radial direction relative to said turret generally toward and away from said turret by said supporting means.

8. An applicator mechanism for a container making machine as set forth in claim 1 wherein said applicator mechanism includes means for activating said applicator means to apply fluent material to said associated surface in timed relation to the movement of said turret.

9. An applicator mechanism for a container making machine as set forth in claim 8 wherein said activating means comprises a photoelectric cell.

10. An applicator mechanism as set forth in claim 1 wherein said supporting means comprises a slide assembly supporting said applicator means for sliding movement generally toward and away from said turret and means for biasing said applicator means toward said turret and said means for moving said applicator comprises a cam carried by said turret and a roller follower carried by said slide assembly and disposed in the path of said cam.

* * * * *